United States Patent [19]

Tani et al.

[11] 4,098,501

[45] Jul. 4, 1978

[54] CASSETTE TYPE SHEET FEED APPARATUS FOR COPYING MACHINE OR THE LIKE

[75] Inventors: Tatsuo Tani; Mitsuo Tanaka; Toshiaki Kameyama, all of Tokyo, Japan

[73] Assignee: Ricoh Company, Ltd., Tokyo, Japan

[21] Appl. No.: 738,205

[22] Filed: Nov. 3, 1976

[30] Foreign Application Priority Data

Nov. 6, 1975 [JP] Japan ..... 50-133207

[51] Int. Cl.[2] ..... B65H 3/06; B65H 1/26

[52] U.S. Cl. ..... 271/117; 221/198; 221/242; 271/127; 271/164; 271/171

[58] Field of Search ..... 271/171, 117, 127, 118, 271/170, 164, 121, 126, 109, 116, 169, 160, 21, 114, 124, 125, 34, 35, 238, 240; 221/242, 241, 231, 197, 198; 214/8.5 H

[56] References Cited

U.S. PATENT DOCUMENTS

| | | | |
|---|---|---|---|
| 2,893,729 | 7/1959 | Perzentka | 271/170 X |
| 3,647,207 | 3/1972 | McPherson | 271/171 X |
| 3,651,933 | 3/1972 | Bell | 271/171 X |
| 3,977,666 | 8/1976 | Suzuki et al. | 271/171 X |

FOREIGN PATENT DOCUMENTS

| | | | |
|---|---|---|---|
| 958,525 | 5/1964 | United Kingdom | 221/198 |

*Primary Examiner*—Bruce H. Stoner, Jr.
*Attorney, Agent, or Firm*—Frank J. Jordan

[57] ABSTRACT

A frame selectively supports sheet cassettes of various widths, one edge of the selected cassette being aligned against a first side wall of the frame. A first feed roller is operatively disposed above the selected cassette and spaced by a predetermined distance from the first side wall. For a maximum size cassette, the opposite edge of the cassette is aligned with a second side wall of the frame. A second feed roller is axially movable and embraced by a roller carrier which is biased into engagement with the second side wall so that the second feed roller is spaced from the second side wall by the same predetermined distance to ensure symmetrical sheet feed. A stop member integral with the roller carrier abuttingly prevents narrower cassettes from being inserted into the frame. To utilize a narrower cassette, an insert is mounted on the frame so that the edges of the cassette engage with the first side wall of the frame and with the insert respectively. The stop member prevents insertion of even narrower cassettes and the insert prevents insertion of wider cassettes.

9 Claims, 10 Drawing Figures

CASSETTE TYPE SHEET FEED APPARATUS FOR COPYING MACHINE OR THE LIKE

BACKGROUND OF THE INVENTION

The present invention relates to a cassette type sheet feed appparatus for a copy machine or the like.

Cassette type sheet feed systems are especially advantageous for use in office copying machines, printing machines and the like since they offer convenience and facilitate automated sheet feed. In such a system, sheets of various standard sizes are provided in respectively sized cassettes, which are inserted into a frame. The system is found in two basic types; a first type in which only one cassette is insertable into the frame at once and a second type in which several cassettes are inserted into the frame at once in a vertically stacked arrangement and a selective feed means feeds sheets from only the selected cassette.

From the point of view of economy of manufacture, it is desirable to design the spaces in the frame which receive the cassettes to be all of the same size, which corresponds to the largest available cassette. A plurality of feed rollers are axially spaced on a drive shaft in the frame above each inserted cassette to feed sheets one by one from the cassette to an electrostatic copying machine or other printing machine.

The cassette is typically aligned against one side wall of the frame. Whereas the rollers are symmetrically positioned relative to the sheets in the cassette when the largest cassette is inserted in the frame, the rollers are asymmetrically positioned relative to the sheets when a narrower cassette is inserted in the frame. This results in skewed feeding of the sheets, jams and tearing.

Especially in an application in which several cassettes are inserted in the frame at once, it is necessary to provide some means for maintaining narrow cassettes rigidly in place and preventing all but the correctly sized cassette to be inserted in a particular space in the frame. These problems have remained heretofore unsolved in the prior art.

SUMMARY OF THE INVENTION

It is an object of the invention to provide a cassette type sheet feed apparatus for a copying machine or the like which overcomes the problems of the prior art enumerated above.

It is another object of the invention to provide a sheet feed apparatus comprising means for allowing only a cassette of correct size to be inserted in a respective space in a frame.

It is another object of the invention to provide a sheet feed apparatus comprising two feed rollers and means for maintaining the feed rollers equally spaced from the opposite side walls of a cassette regardless of the width of the cassette.

It is another object of the invention to provide a sheet feed apparatus which ensures symmetrical feeding of sheets and eliminates the cause of sheet jams.

It is another object of the invention to provide a sheet feed apparatus comprising an axially fixed feed roller and an axially movable feed roller and means for positioning the axially movable feed roller at the same distance from one side wall of a cassette as the axially fixed feed roller is positioned from the opposite side wall of the cassette regardless of the width of the cassette.

It is another object of the invention to provide a generally improved sheet feed apparatus for an office copying machine or the like.

Other objects, together with the foregoing, are attained in the embodiment described in the following description and illustrated in the accompanying drawings.

DESCRIPTION OF THE PREFERRED EMBODIMENT

While the cassette type sheet feed apparatus of the invention is susceptible of numerous physical embodiments, depending upon the environment and requirements of use, substantial numbers of the herein shown and described embodiment have been made, tested and used, and all have performed in an eminently satisfactory manner.

Figure 1:
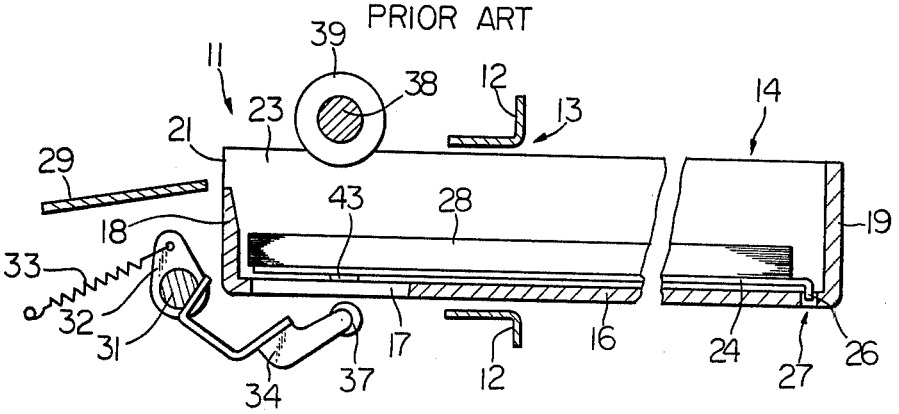
Fig. 1 PRIOR ART
FIG. 1 is a partial side schematic view illustrating a prior art sheet feed system to which the invention constitutes a novel improvement in an inoperative status.
Figure 2:
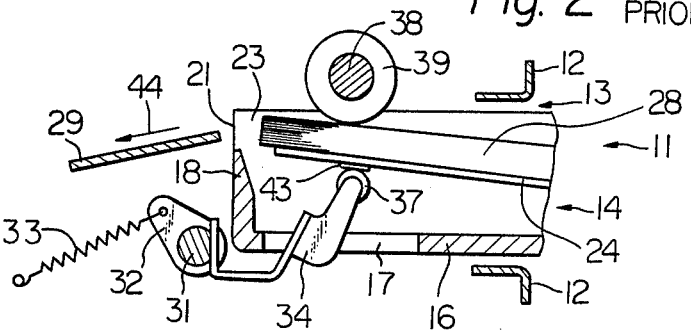
Fig. 2 PRIOR ART
FIG. 2 is similar to FIG. 1 but shows the prior art sheet feed apparatus in an operative status.
Figure 3:
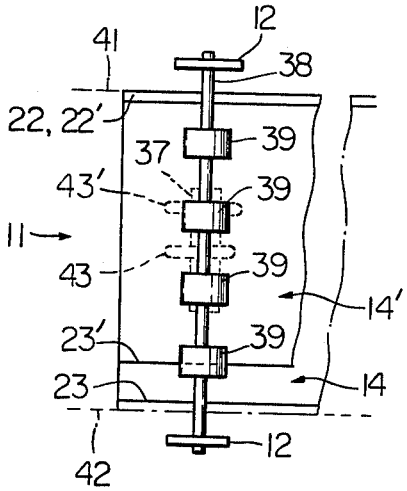
Fig. 3 PRIOR ART
FIG. 3 is an overhead schematic view of the prior art sheet feed apparatus.

Referring now to FIGS. 1 to 3 of the drawing, a prior art sheet feed apparatus 11 generally comprises a frame 12 formed with an opening 13 to receive a cassette 14 of maximum width. Although the frame 12 is shown only in fragmentary form, it will be understood that it supports the cassette 14 in the space interior of the opening 13. The cassette 14 comprises a bottom wall 16 which is formed with a hole 17 and parallel front and rear walls 18 and 19 respectively. The upper portion of the front wall 18 is cut away as designated at 21 so that the front wall 18 is shorter than the rear wall 19. In addition, the cassette 14 is provided with parallel side walls 22 and 23 connecting the front and rear walls 18 and 19 which have the same height as the rear wall 19. A sheet supporting plate 24 is supported on the bottom wall 16 of the cassette 14 and is formed with a plurality of downwardly extending lugs 26 which engage in conjugate holes 27 formed in the bottom plate 16. A plurality of sheets 28 of a size corresponding to the size of the cassette 14 are provided in a stack on the plate 24 and a guide 29 is provided adjacent to the front wall 18.

Figure 4:
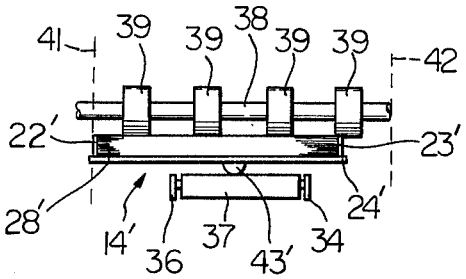
Fig. 4 PRIOR ART
FIGS. 4 and 5 are front elevations showing the prior art sheet feed apparatus operatively feeding sheets from a narrow cassette and a wide cassette respectively.

An actuator shaft 31 has an arm 32 fixed thereto which is connected at its end to one end of a tension spring 33. The other end of the tension spring 33 is connected to a fixed part of the frame 12 which is not shown. Arms 34 and 36 (see FIG. 4 or 5) are fixed to the shaft 31 in axially spaced relation and rotatably support therebetween an actuator roller 37. A roller shaft 38 is rotatably supported by the frame 12 above the sheets 28 near the front wall 18 of the cassette 14. Four feed rollers 39 are mounted in axially spaced relation on the shaft 38 through one-way clutches (not shown) so as to be rotatable integrally with the shaft 38 in the clockwise direction as viewed in FIG. 1. As best seen in FIG. 3, the side walls 22 and 23 of the cassette 14 are engaging aligned with side walls of edge guides 41 and 42 respectively of the frame 12 when the cassette 14 is inserted therein. The bottom surface of the plate 24 is provided with a downwardly extending projection 43 equally spaced between the side walls 22 and 23 and being exposed through the hole 17.

FIG. 1 shows the sheet feed apparatus 11 in an inoperative status in which the actuator shaft 31 is rotated clockwise by means which are not shown so that the roller 37 disengages from the projection 43. This allows the cassette 14 to be inserted into or removed from the frame 12 through the opening 13 parallel to the edge guides 41 and 42 and also enables the cassette 14, even though mounted in the frame 12, to be maintained in an inoperative status.

In FIG. 2, said means is de-activated and the spring 33 causes counterclockwise rotation of the actuator shaft 31 so that the roller 37 engages with the projection 43 of the plate 24 and tilts the plate 24 and sheets 28 clockwise about the lugs 26 in a unitary manner so that the upper sheet 28 engages with the feed rollers 39. Rotation of the roller shaft 38 and thereby the feed rollers 39 in the clockwise direction in FIG. 2 by drive means which are not shown causes the top sheet 28 to be fed out of the cassette 14 over the guide 29 as indicated by an arrow 44 to a copying machine or the like for use.

Figure 5:
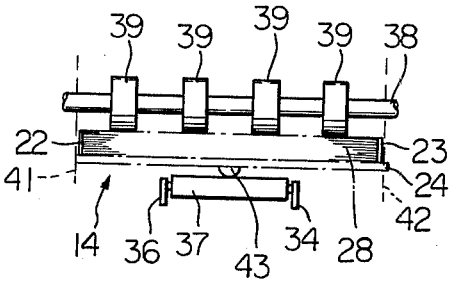
Fig. 5 PRIOR ART

FIG. 5 shows how the feed rollers 39 are symmetrically arranged relative to the sheets 28 so that feeding force is applied to the sheets 28 symmetrically and the sheets 28 are fed out of the cassette 14 without skewing or jamming. However, FIGS. 3 and 4 further illustrate a second cassette 14', which is essentially similar to the cassette 14 except that it is narrower. Like elements are designated by the same reference numerals suffixed by an apostrophe.

In a conventional manner, the side wall 22' of the cassette 14' is aligned with the edge guide 41 of the frame 12 and the side wall 23' is spaced from the edge guide 42. It will be seen that the rollers 39 are not, in this case, symmetrically arranged relative to the narrower sheets 28' and that this arrangement will result in skewed feeding which gives rise to sheet jams and tears.

This drawback is overcome in the present sheet feed apparatus 51 which is illustrated in FIGS. 6 to 10. Since the same cassettes 14 and 14' are used in the apparatus 51, they are designated by the same referece numerals and will not be described repetitiously.

The apparatus 51 comprises a frame 52 having parallel side walls or edge guides 53 and 54. The cassette 14 is inserted into the frame 52 through an opening (not shown) from right to left as viewed in FIG. 6 so that the front wall 18 abuts against perpendicular extensions **53*a* and 54*a* of the edge guides 53 and 54. The side walls 22 and 23 of the cassette 14 aligningly engage with the edge guides 53 and 54** respectively.

A roller shaft 56 is rotatably supported above the cassette 14 near the front wall 18 which supports an axially fixed first feed roller 57. The feed roller 57 is connected to the roller shaft 56 through a one-way clutch which is not shown so as to be integrally rotatable with the shaft 56 in the clockwise direction as viewed in FIG. 8. A second feed roller 58 is also mounted on the roller shaft 56 through a similar one-way clutch (not shown). However, the feed roller 58 is axially slidable on the roller shaft 56 by means of a spline connection or the like (not shown).

A carrier shaft 59 is rigidly supported by the frame 52 parallel to the roller shaft 56 and axially slidably supports a roller carrier 61 thereon. As shown in detail in FIGS. 8 and 9 the roller carrier 61 comprises a base plate **61*a*. Arms 61*b* and 61*c* perpendicularly extend from the base plate 61*a* which are formed with holes 61*d* and 61*e* through which the carrier shaft slidably extends. The arm 61*b* serves as a stop member as will be described in detail below. A tension spring 62 is connected between the arm 61*c* and a fixed member 63 of the frame 52 which urges the roller carrier 61 toward the edge guide 54**.

Figure 6:
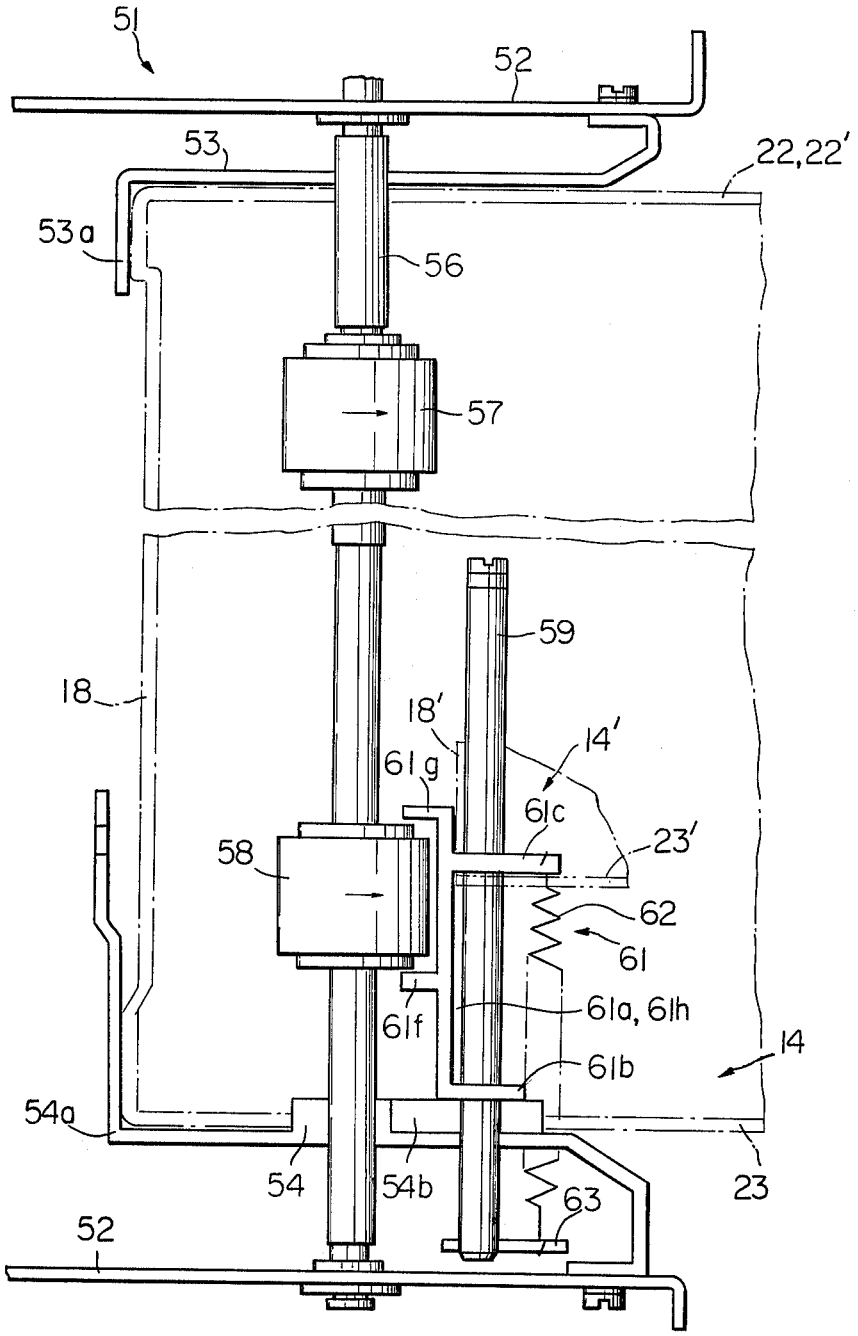
FIG. 6 is an overhead schematic view of a sheet feed apparatus of the present invention operatively feeding sheets from a wide cassette.
Figure 10:
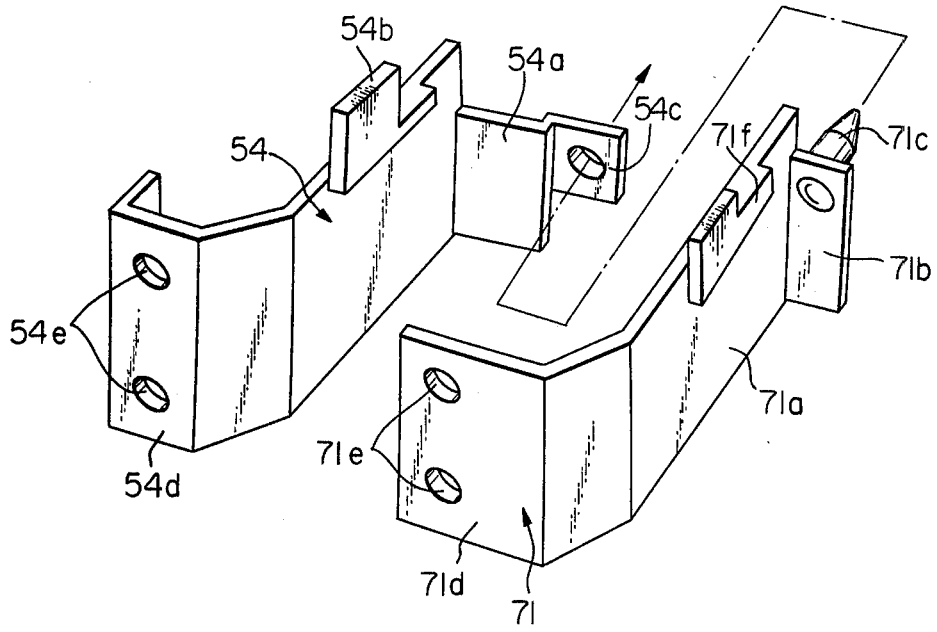
FIG. 10 is a partial exploded view of a frame and an insert of the present sheet feed apparatus.

As best seen in FIGS. 6 and 10, the edge guide 54 is formed with a stop **54*b* at a position above the side wall 23 of the cassette 14. The spring 62 urges the roller carrier 61 into engagement with the edge guide 54 in such a manner that the arm 61*b* abuts against the stop 54*b***.

The roller carrier 61 is further formed with arms **61*f* and 61*g* which extend perpendicularly from the base plate 61*a* and embrance the feed roller 58 from opposite sides. It is clear that since the feed roller 58 is axially slidable on the roller shaft 56 and is axially embraced by the arms 61*f* and 61*g* of the roller carrier 61, the feed roller 58 is axially movable by and with the roller carrier 61** in a unitary manner.

The spacing of the arms **61*b*, 61*f* and 61*g* of the roller carrier 61 is predetermined in such a manner that with the arm 61*b* in engagement with the stop member 54*a* of the edge guide 54, the distance between the second feed roller 58 and the edge guide 54 will be the same as the distance between the first feed roller 57 and the edge guide 53. Thus, with the cassette 14 supported in the frame 52, the feed rollers 57 and 58 are symmetrically disposed relative to the sheets 28 in the cassette 14** and the possibility of sheet jams and tears caused by skewed sheet feed does not exist.

The roller carrier 61 is further formed with a cassette stop member **61*h* which constitutes a downward extension of the base plate 61*a*. The stop member 61*h* extends below the height of the side wall 23 of the cassette 14 but does not extend below the height of the cut out front wall 18. The stop member 61*h* extends axially inward of the edge guide 54 by a distance slightly greater than the distance between the side wall 23' of the cassette 14', which will here be assumed to be of a minimum width which the apparatus 51 is designed to accommodate, and the edge guide 54. In this manner, as illustrated in FIG. 6, the front edge of the side wall 23' will abut against the stop member 61*h* if an attempt is made to insert the cassette 14' into the frame 52 and the cassette 14' will be prevented from being inserted into the frame 52 past the roller carrier 61. Similarly, any cassette having a width intermediate between the cassette 14' and the cassette 14 will be prevented from being inserted into the frame 52. This design is especially advantageous in an application in which a plurality of cassettes are inserted into a frame in a vertically stacked arrangement since it ensures that only the widest cassette 14** may be inserted into the space which is designed to receive it.

It will be understood that the cassette 14 is not prevented from being inserted into the frame 52 in this instance since the front wall 18 is cut away to a height below the stop member 61*h* and the side wall 23 of the cassette 14 is disposed below the stop member 54*a* of the edge guide 54 rather than below the stop member 61*h* of the roller carrier 61.

Figure 7:
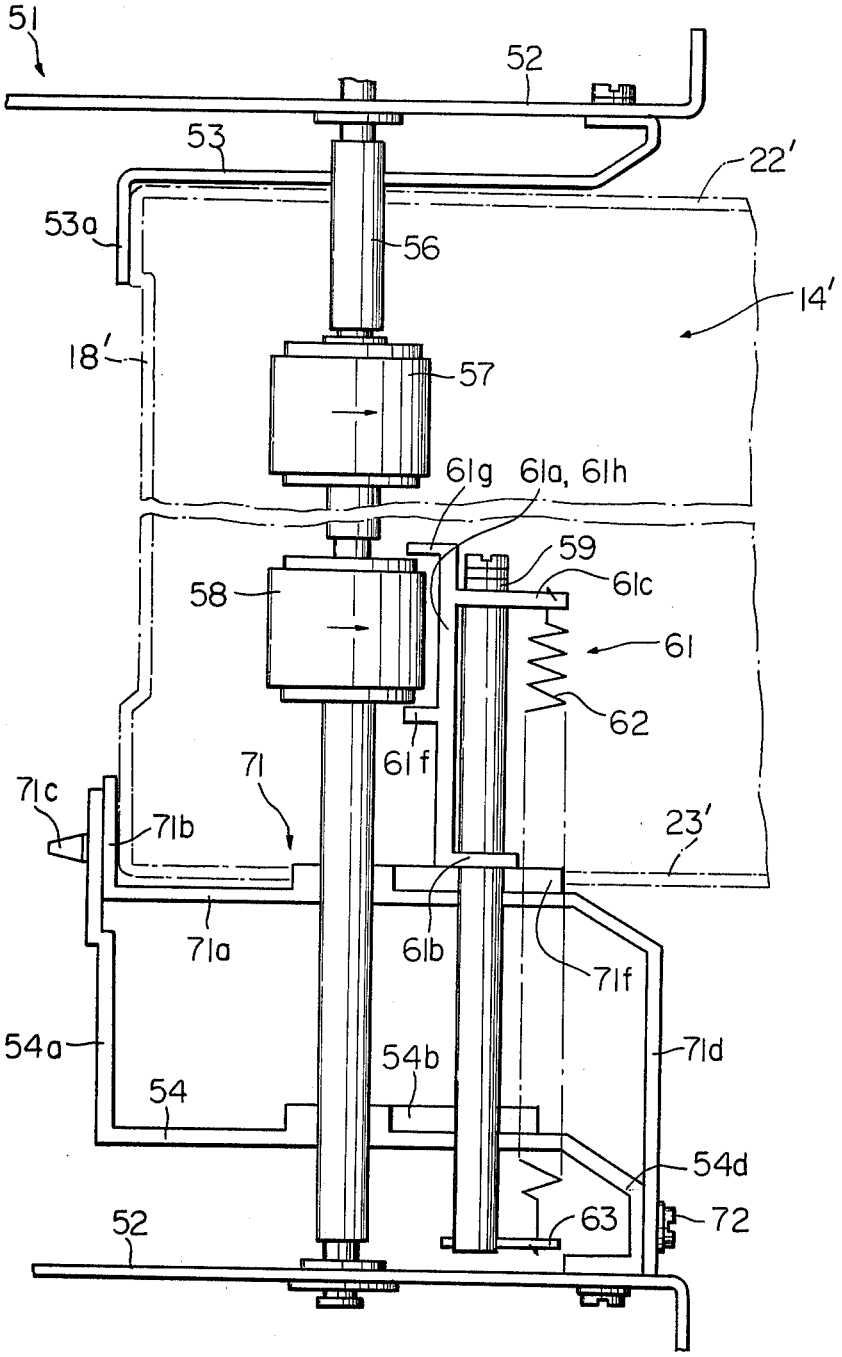
FIG. 7 is similar to FIG. 6 but shows the present sheet feed apparatus operatively feeding sheets from a narrow cassette.
Figure 8:
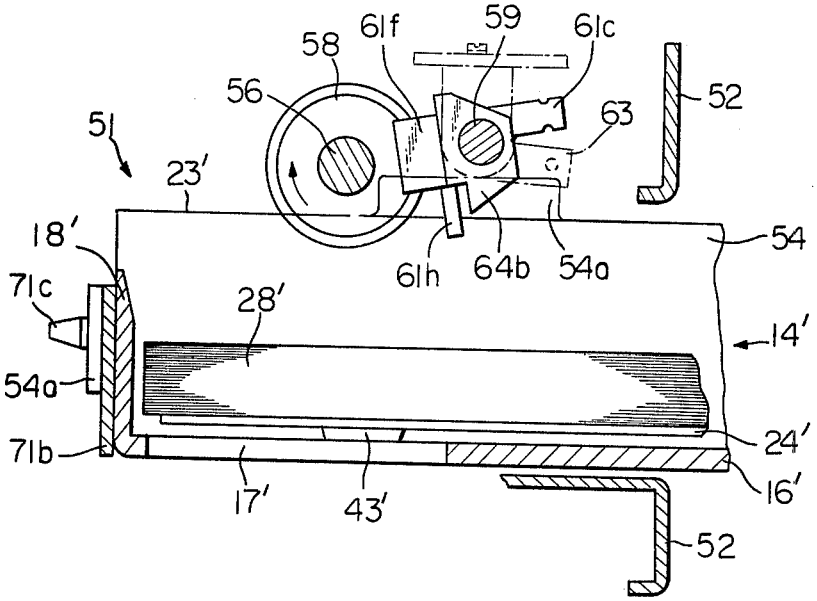
FIG. 8 is a partial side schematic view of the present sheet feed apparatus.
Figure 9:
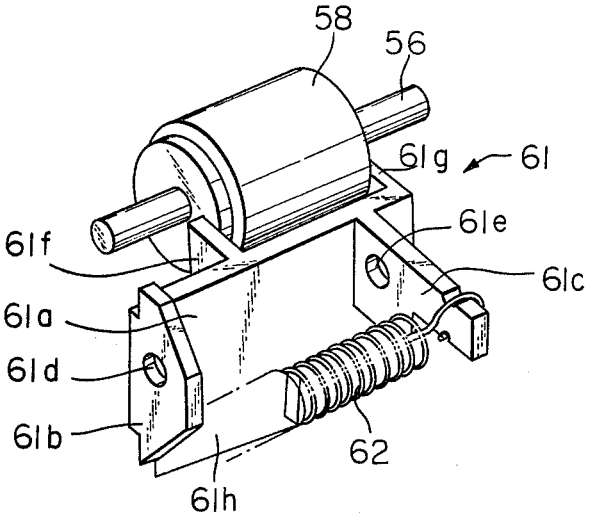
FIG. 9 is a perspective view of part of the present sheet feed apparatus.

In order to adapt the frame 52 to accommodate only the cassette 14' for example, an insert 71 which is most clearly illustrated in FIGS. 7 and 10, is mounted on the frame 52. When mounted in place, the insert 71 comprises an edge guide 71*a* which extends between and parallel to the edge guides 53 and 54 of the frame 52 and an extension 71*b* which extends parallel to and abuts against the extension 54*a* of the edge guide 54. To enable connection of the extensions 54*a* and 71*b*, the extension 54*a* is formed with a hole 54*c* into which engages a pin 71*c* which extends perpendicularly from the extension 71*b*. The edge guide 54 further comprises a perpendicular extension 54*d* which is formed with threaded holes 54*e*. In a similar manner, the insert 71 is formed with a perpendicular extension 71*d* which is formed with holes 71*e* conjugate to the holes 54*e*. Bolts 72 serve to rigidly connect the extension 71*d* to the extension 54*d*. In addition, the edge guide 71*a* of the insert 71 is formed with a stop member 71*f* which is identical to the stop member 54*b* of the edge guide 54.

The spacing between the edge guides 71*a* and 54 is predetermined so that with the cassette 14' inserted between the edge guides 53 and 71*a'*, as shown in FIG. 7, the side walls 22' and 23' of the cassette 14' will be in engaging alignment therewith.

To mount the insert 71, the roller carrier 61 is moved against the force of the spring 62 toward the edge guide 53 sufficiently for the insert 71 to be mounted between the roller carrier 61 and the edge guide 54. The pin 71*c* is inserted in the hole 54*c* and the bolts 72 are screwed into the holes 54*e* through the holes 71*e*. The roller carrier 61 is released so that the arm 61*b* abuts against the stop member 71*f* of the insert 71.

Since the stop member 71*f* is identical to the stop member 54*b*, with the arm 61*b* of the roller carrier 61 in engagement with the stop member 71*f* of the insert 71 the distance between the second feed roller 58 and the edge guide 71*a* will be the same as the distance between first feed roller 57 and the edge guide 53. In the same manner as with the wide cassette 14, the feed rollers 57 and 58 will be symmetrically disposed relative to the sheets 28' in the cassette 14' and sheet jams and tears will be positively prevented. In addition, the insert 71 abuttingly prevents insertion of a cassette wider than the cassette 14' into the frame 52 when operatively mounted.

Although only two cassettes 14' and 14 and one insert 71 for the cassette 14' have been shown and described, it is clear that any number of cassettes having widths intermediate between the cassettes 14' and 14 may be utilized if correspondingly sized inserts are provided. In each case, the insert will prevent inadvertent insertion of either a smaller or a larger sized cassette than the one intended and will also position the feed rollers 57 and 58 at equal distances from the opposite sides of the cassettes. In this manner, skewed feed and inadvertent insertion of a wrong sized cassette into a particular space are positively prevented by the present invention.

Although an actuator roller and associated components are not shown in FIGS. 6 to 10 for simplicity, it is understood that they are provided in the same manner as shown and described with reference to FIGS. 1 to 5. It is further understood that suitable drive means (not shown) are provided to rotate the roller shaft 56 clockwise in FIG. 8 to effect sheet feed.

Many modifications will become possible for those skilled in the art after receiving the teachings of the present disclosure without departing from the scope thereof.

What is claimed is:

1. A sheet feed apparatus comprising:

a frame having first and second parallel side walls;

a sheet cassette detachably inserted into the frame and engaging at a first side wall thereof with the first side wall of the frame and at a second side wall thereof with the second side wall of the frame;

a first axially fixed feed roller operatively disposed above said cassette and spaced from the first side wall of said cassette by a predetermined distance;

a second axially movable feed roller operatively disposed above said cassette; and means for axially positioning the second feed roller so as to be spaced from the second side wall of said cassette by the predetermined distance;

said means comprising an axially movable roller carrier embracing the second feed roller, and biasing means urging the roller carrier into engagement with the second side wall of the frame.

2. A sheet feed apparatus as in claim 1, in which the roller carrier is formed with a stop member for engagement with the second side wall of the frame.

3. A sheet feed apparatus as in claim 1, further comprising a second sheet cassette having first and second parallel side walls and which is narrower than said cassette, the roller carrier being further formed with a cassette stop member having a width slightly greater than the distance between the second side wall of the second cassette and the second side wall of the frame to abuttingly prevent insertion of the second cassette into the frame parallel to the first and second side walls thereof when the roller carrier is in engagement with the second side wall of the frame.

4. A sheet feed apparatus as in claim 3, further comprising an insert detachably mountable on the frame between the first and second side walls thereof to extend parallel thereto, the second cassette engaging at the first and second side walls thereof with the first side wall of the frame and with the insert respectively when the second cassette is inserted into the frame parallel to the first and second side walls thereof, the roller carrier being urged by the biasing means so that said stop member thereof engages with the insert, the cassette stop member being dimensioned so as to allow insertion of the second cassette into the frame when the insert is mounted thereon and the roller carrier is in engagement with the insert, the insert abuttingly preventing insertion of said cassette into the frame parallel to the side walls thereof.

5. A sheet feed apparatus as in claim 3, in which the second cassette comprises a bottom wall formed with a hole therethrough and a sheet supporting plate tiltably supported on the bottom wall, the apparatus further comprising an actuator insertable into the second cassette through the hole to tilt the plate toward the first and second feed rollers.

6. A sheet feed apparatus as in claim 1, further comprising a roller shaft, the first feed roller being axially fixed on the roller shaft and the second feed roller being axially slidable on the roller shaft.

7. A sheet feed apparatus as in claim 6, further comprising a carrier shaft extending parallel to the roller shaft and axially slidably supporting the roller carrier.

8. A sheet feed apparatus as in claim 1, in which said cassette comprises a bottom wall formed with a hole therethrough and a sheet supporting plate tiltably supported on the bottom wall, the apparatus further comprising an actuator insertable into said cassette through the hole to tilt the plate toward the first and second feed rollers.

9. A sheet feed apparatus as in claim 1, in which the biasing means comprises a spring.

* * * * *